United States Patent [19]

Hernandez

[11] 4,315,257

[45] Feb. 9, 1982

[54] METHOD AND DEVICE FOR ADDRESSING A PAGE MEMORY IN A VIDEOTEX SYSTEM

[75] Inventor: Charles Hernandez, Villejuif, France

[73] Assignee: Telediffusion de France & Compagnie Continentale de Signalisation, Paris, France

[21] Appl. No.: 152,497

[22] Filed: May 22, 1980

[30] Foreign Application Priority Data

May 23, 1979 [FR] France ..... 79 13240

[51] Int. Cl.[3] ..... G09G 1/16

[52] U.S. Cl. ..... 340/723; 340/744; 340/789; 340/799

[58] Field of Search ..... 340/723, 744, 745, 789, 340/799, 703

[56] References Cited

U.S. PATENT DOCUMENTS

| | | | |
|---|---|---|---|
| 3,685,038 | 8/1972 | Flanagan | 340/703 |
| 3,911,418 | 10/1975 | Takeda | 340/703 |
| 4,190,835 | 2/1980 | Buynak | 340/799 X |
| 4,200,869 | 4/1980 | Murayama et al. | 340/723 |

*Primary Examiner*—David L. Trafton

*Attorney, Agent, or Firm*—Holman & Stern

[57] ABSTRACT

A method for addressing a page memory in a videotex system, said page memory being capable of storing the character data required for displaying one page of text, each page comprising 25 rows of 40 characters each, the first row being a service row, said memory having 1024 available positions, wherein the 24 positions not dedicated to character data are respectively allocated to the 24 rows other than the first row for reading out data common to all the characters of the row in consideration.

4 Claims, 1 Drawing Figure

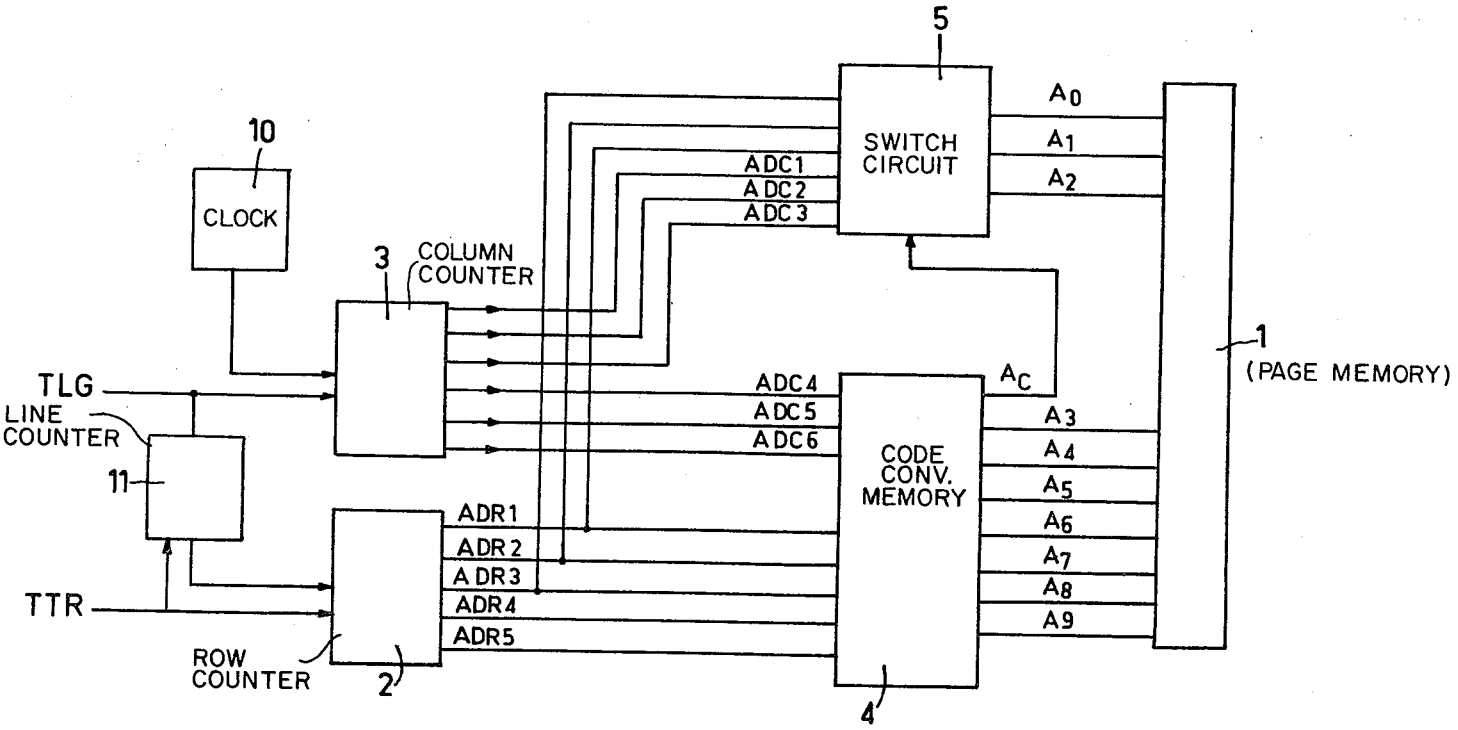
(PAGE MEMORY)
1
A0
A1
A2
AC
A3
A4
A5
A6
A7
A8
A9
5
SWITCH CIRCUIT
CODE CONV. MEMORY
4
ADC1
ADC2
ADC3
ADC4
ADC5
ADC6
COLUMN COUNTER
3
ADR1
ADR2
ADR3
ADR4
ADR5
2
ROW COUNTER
10
CLOCK
11
TLG
LINE COUNTER
TTR

METHOD AND DEVICE FOR ADDRESSING A PAGE MEMORY IN A VIDEOTEX SYSTEM

The invention relates to a method and a device for delivering the read out addresses of a page memory in a videotex decoder.

There is disclosed in French patent application No. 2,363,949 a system for displaying data on the screen of an ordinary television set, usually called a videotex system. In such a system, the data are broadcast by a transmitter station in form of time multiplexed channels, and each channel, called magazine, consists of data blocks and is divided into pages. The viewer having a TV set equipped with a videotex decoder, once he has selected a given magazine, selects a given page and the corresponding data are written in a page memory and are read out in a character generator for purposes of displaying a page of written text on the screen of the TV set.

In accordance with the ANTIOPE specification, each page comprises 25 horizontal rows of 40 characters, each row occupying 10 scanning lines. The capacity of the page memory should then be $25\times40=1000$ character data.

But it is well known that in practice, the memory capacities are always powers of 2. Thus, the effective capacity of the page memory will be 1024 data, which leaves 24 available positions.

The invention aims at utilizing in optimum manner the capacity of the page memory.

The invention takes advantage of the fact that the first row is a service row which is always displayed on the screen of the TV set in the same way, with single height characters, whereas for the remaining rows, the possibility must be offered to vary the display mode, for instance by doubling the height of the characters, concealing the characters, etc. According to the invention, the 24 available memory positions are respectively allocated to the 24 rows other than the first one for reading out data common to all the characters of the row in consideration.

The data in consideration may be the indication that the row only contains double height characters, or the indication that the row is an upper row, or a lower row, taking in account the possibility of producing double height characters which occupy two successive rows. These data will be fed to the character generator to allow an adequate character alignment to be achieved.

It may also be the instruction to conceal the characters of a row.

The invention also provides a device for addressing a page memory, comprising a counter delivering a parallel 5-bit sequence ADR1 to ADR5 for supplying the row addresses, a counter delivering a parallel 6-bit sequence ADC1 to ADC6 for supplying the column addresses, and a code converting circuit for setting forth correspondence between, on the one hand a pair of row address between 0 and 24 and a column address between 0 and 39, and on the other hand a character address between 0 and 999 which is fed to the memory in form of a parallel 10-bit sequence $A_0$ to $A_9$, said circuit delivering to the page memory the the row address ADR1 to ADR5 unchanged when it receives a column address of at least 40.

Due to the row addresses with a column address of at least 40 being passed unchanged, read out addresses are provided for positions 1000 to 1023 left available in the page memory.

In an advantageous embodiment, the code converting circuit comprises a code conversion memory receiving the bits ADR1 to ADR5 indicative of the row address and the three bits ADC4 to ADC6 of higher weight, the three bits ADC1 to ADC3 being directly passed to the page memory.

It is here taken advantage of the fact that the addresses of the last characters of each row are always expressed by a number $8k+7$ as the numbers of the first characters are 0, 40, 80, etc. Thus, the three bits of lower weight may not be subjected to code conversion. A memory of reduced capacity may be used as a $256\times7$ bits capacity is sufficient instead of $2048\times10$ bits.

Preferably the three bits ADC1 to ADC3 are fed to a switch circuit also receiving the three low-weight bits ADR1 to ADR3, the switch circuit being controlled by a signal derived from the code conversion memory, the switch circuit passing the bits ADC1 to ADC3 when the bits ADC4 to ADC6 fed to the code conversion memory represent a value less than 40, and the bits ADR1 to ADR3 in the opposite case, the code conversion memory passing then the bits ADR4 and ADR5 without modification.

The invention will be made more clear upon reading the following description with reference to the annexed drawing which shows the addressing device according to the invention.

The addressing device shown in the drawing is intended to supply the read out addresses of a page memory 1 capable of storing the character data required for displaying a page of text on the screen of a TV set, the characters being produced by a character generator, not shown.

In the ANTIOPE system, a page consists of 25 rows of 40 characters and therefore comprises 1000 characters.

Memory 1 is a RAM memory with an effective capacity of $1024\times20$ bits. From 1024 positions, 1000 are occupied by character data, and 24 positions thus remain available.

The first row is a service row which is always displayed on the screen of the TV set in the same way, with single height characters. For the other rows, it must be possible to modify the display mode, e.g. by doubling the character height, by concealing characters, etc. According to the invention, the 24 available memory positions are each allocated to a row other than the first row, the data entered at such positions being control code words which apply to all the characters of a row.

The above-described device implements such a manner of addressing the 24 available positions.

The addressing device comprises a row counter 2 capable of delivering in parallel 5 bits ADR1 to ADR5 representing numbers 0 to 31 and a column counter 3 delivering 6 bits ADC1 to ADC6 representing numbers 0 to 63. The column counter 3 is incremented by a clock 10 defining the character time slot, equal to 10 picture dots in the ANTIOPE system, i.e. about 1 microsecond, and it is reset to zero at each line synchronization pulse TLG, i.e. every 64 microseconds.

The row counter 2 is incremented every 10 lines by the line counter 11 which receives the line synchronization pulses TLG. It is reset to zero by the field synchronization pulse TTR which also resets to zero the line counter 11.

Counters 2 and 3 together could thus provide $32 \times 64 = 2048$ read out addresses. As only 1024 read out addresses are required, there is provided a code converting circuit comprising a PROM-type code conversion memory 4 and a two-way switch circuit 5, marketed under the term multiplexer.

The code conversion memory 4 receives the row addresses conveyed by wires ADR1 to ADR5 and the column address bits ADC4 to ADC6 of higher weight, whereas the bits ADC1 to ADC3 of lower weight are fed to the switch circuit 5 and are passed without code conversion to the page memory 1 via wires $A_0$, $A_1$, $A_2$.

The code conversion memory 4 sets forth correspondence between a pair of values conveyed by wires ADC4 to ADC6 and ADR1 to ADR5, respectively, and a value conveyed by the 7 wires $A_3$ to $A_9$ connected to the page memory, and the wires $A_0$ to $A_9$ together convey a read out address between 0 and 999 to allow addressing of 1000 character data.

For instance, with a column address equal to 15 and a row address equal to 8, the read out address fed to the page memory will be $40 \times 8 + 15 = 335$.

The opportunity of passing without code conversion the 3 bits ADC1 to ADC3 of low weight is allowed by the fact that the last column address of each row is always expressed by a number $8k+7$ (k integer) since the number of characters in a row is 40 i.e. a multiple of 8.

This reduces the storage capacity required for code conversion to $256 \times 7$ bits instead of $2048 \times 10$ bits if the column address was integrally fed to memory 4.

Further, the 3 row address bits of low weight ADR1 to ADR3 are also applied to switch circuit 5, which passes the same unchanged to the page memory in one of its two operating states, the other state involving transmission of the column address bits ADC1 to ADC3.

The operating state of switch circuit 5 is controlled by the level of the signal present at an 8th output $A_C$ of the code conversion memory 4.

As long as the value conveyed by wires ADC4 to ADC6 to the code conversion memory 4 is less than 40, the switch circuit 5 passes bits ADC1 to ADC3. During this step, the page memory receives the 1000 addresses to allow the character data to be read out.

When the value conveyed by wires ADC4 to ADC6 reaches 40, which corresponds to 1 for ADC6, 0 for ADC5 and 1 for ADC4, the state of output $A_C$ changes and the switch circuit 5 passes the row address bits ADR1 to ADR3. Simultaneously, the memory 4 owing to its programmation passes without modification the row addresses ADR4 and ADR5.

The page memory 1 then receives the row address in its entirety, which allows reading out one of the 24 positions not allocated to character data.

When the value conveyed by wires ADC4 to ADC6 reaches 48, i.e. 110 in binary code, the output $A_C$ resumes its original state. The page memory 1 again receives the character addresses from the time that the column counter 3 is reset to zero.

What I claim is:

1. A method for addressing a page memory in a videotex system, said page memory being capable of storing the character data required for displaying one page of text, each page comprising 25 rows of 40 characters each, the first row being a service row, said memory having 1024 available positions, wherein the 24 positions not dedicated to character data are respectively allocated to the 24 rows other than the first row for reading out data common to all the characters of the row in consideration.

2. A device for addressing a page memory in a videotex system, said page memory being capable of storing the character data required for displaying one page of text, each page comprising 25 rows of 40 characters each, the first row being a service row, said memory having 1024 available positions, said device comprising a counter delivering a parallel 5-bit sequence ADR1 to ADR5 for supplying the row addresses, a counter delivering a parallel 6-bit sequence ADC1 to ADC6 for supplying the column addresses and a code converting circuit for setting forth correspondence between, on the one hand a pair of a row address between 0 and 24 and a column address between 0 and 39, and on the other hand a character address between 0 and 999 which is fed to the memory in form of a parallel 10-bit sequence $A_0$ to $A_9$, said circuit delivering to the page memory the row address ADR1 to ADR5 unchanged when it receives a column address of at least 40.

3. The device of claim 2, wherein the code converting circuit comprises a code conversion memory receiving the bits ADR1 to ADR5 indicative of the row address and the three bits ADC4 to ADC6 of higher weight, the three bits ADC1 to ADC3 being directly passed to the page memory.

4. The device of claim 3, wherein the three bits ADC1 to ADC3 are fed to a switch circuit also receiving the three low-weight bits ADR1 to ADR3, the switch circuit being controlled by a signal derived from the code conversion memory, the switch circuit passing the bits ADC1 to ADC3 when the bits ADC4 to ADC6 fed to the code conversion memory represent a value less than 40, and the bits ADR1 to ADR3 in the opposite case, the code conversion memory passing then the bits ADR4 and ADR5 without modification.

* * * * *